United States Patent [19]

Magoon

[11] Patent Number: 4,586,422

[45] Date of Patent: May 6, 1986

[54] IN-LINE ANNULAR PISTON FIXED BOLT REGENERATIVE VARIABLE CHARGE LIQUID PROPELLANT GUN WITH VARIABLE HYDRAULIC CONTROL OF PISTON

[75] Inventor: Inder K. Magoon, Pittsfield, Mass.

[73] Assignee: General Electric Company, Fairfield, Conn.

[21] Appl. No.: 598,783

[22] Filed: Apr. 10, 1984

[51] Int. Cl.[4] ..... F41F 1/04

[52] U.S. Cl. ..... 89/7; 89/8

[58] Field of Search ..... 89/7, 8, 1.1

[56] References Cited

U.S. PATENT DOCUMENTS

| | | | |
|---|---|---|---|
| 3,138,990 | 6/1964 | Jukes et al. | 89/7 |
| 4,023,463 | 5/1977 | Tassie | 89/7 |
| 4,050,349 | 9/1977 | Graham | 89/7 |
| 4,099,445 | 7/1978 | Singelmann et al. | 89/7 |
| 4,100,836 | 7/1978 | Hofmann | 89/7 |
| 4,269,107 | 5/1981 | Campbell | 89/7 |
| 4,281,582 | 8/1981 | Jagua | 89/7 |
| 4,341,147 | 7/1982 | Mayer | 89/7 |
| 4,523,507 | 6/1985 | Magoon | 89/7 |
| 4,523,508 | 6/1985 | Mayer et al. | 89/7 |

*Primary Examiner*—David H. Brown

*Attorney, Agent, or Firm*—Francis K. Richwine; Bailin L. Kuch

[57] ABSTRACT

A regenerative liquid propellant gun structure in which the differential area piston is annular, has an open peripheral cylindrical skirt extending away from the combustion chamber to define a propellant reservoir, and has an aperture in the piston head permitting overrunning of a fixed bolt. The fixed bolt is cylindrical with an enlarged band to fit the aperture to block flow of propellant until firing and to define with the edge of the aperture a variable annual orifice for propellant injection as the piston moves. There is a second free piston overrunning the bolt having a forward portion mating with both the inside of the differential area piston and the exterior of the cylindrical skirt so that the skirt constitutes a piston in a circular dashpot in the second piston. The second piston also contains a fluid accumulator, fluid conduit means interconnecting the accumulator and the dashpot and means for changing the cross sectional area of the fluid conduit means to provide a variable hydraulic resistance to the differential area piston during firing.

17 Claims, 2 Drawing Figures

IN-LINE ANNULAR PISTON FIXED BOLT REGENERATIVE VARIABLE CHARGE LIQUID PROPELLANT GUN WITH VARIABLE HYDRAULIC CONTROL OF PISTON

The U.S. Government has rights in this invention pursuant to Contract DAAK78-C-0054 awarded by the Department of Army.

RELATED APPLICATIONS

This Application is related to U.S. patent application Ser. Nos. 840,074; 840,075; and 840,104; all three filed Oct. 6, 1977; and U.S. Pat. Nos. 4,523,507 and 4,523,508; both issued June 18, 1985.

BACKGROUND OF THE INVENTION

1. Field of the Invention

This invention relates to liquid propellant guns utilizing differential area pistons to provide continued or regenerative injection of a liquid propellant into the combustion chamber and, particularly, to such guns in which there are a plurality of coaxial elements, including at least one differential area piston, arranged so as to provide for relative action between elements as a means for controlling regenerative propellant injection.

2. Description of the Prior Art

An extensive summary of the prior art appears in the "Description of the Prior Art" of U.S. Pat. No. 4,341,147 to R. E. Mayer. The patents to R. A. Jukes et al, U.S. Pat. No. 3,138,990, June 30, 1964; D. P. Tassie, U.S. Pat. No. 4,023,463, May 17, 1977; and A. R. Graham, U.S. Pat. No. 4,050,349, Sept. 27, 1977; cited in that document and Mayer U.S. Pat. No. 4,341,147 itself are exemplary of that prior art. In general, the references cited show differential pressure pistons for forcing liquid propellent from a reservoir chamber into a combustion chamber responsive to combustion pressures. The most pertinent of the prior art cited to this disclosure are the co-pending U.S. Pat. Nos. 4,523,507 and 4,523,508 in which a moving differential area piston cooperates with another member, i.e., the fixed bolt 5 in FIG. 1 to control the flow rate or dispersion pattern or both of the propellant as it is pumped to the combustion chamber and Jaqua U.S. Pat. No. 4,281,582 which provides a nonuniform resistance to movement of the differential area piston. The older co-pending Applications cited are pertinent because, in a reverse hollow piston arrangement, they also disclose a fill piston and a hydraulic dashpot.

SUMMARY OF THE INVENTION

This invention pertains to a novel breech, receiver and combustion chamber structure for a liquid propellant gun of the regenerative injection monopropellant type and pertains to improvements in structures in which a moveable differential area piston cooperates with at least one other structural element to control propellant flow rate or dispersion pattern or both as the propellant is pumped from a reservoir chamber to a combustion chamber by a piston responsive to combustion pressures. The invention contemplates an in-line annular piston (i.e. axially aligned with the gun bore, surrounding a reservoir space and moving in direct reaction to the projectile) supported within the breech mechanism section for reciprocal overrunning motion axially of a fixed central bolt member wherein the cylindro-annular space between the cylindrical differential area piston wall and the bolt constitutes a reservoir chamber having a capacity between the head of the piston and a moveable third member which is variable from zero to a selected full charge capacity. The zero capacity capability provides a starting position for an air free rapid fill to avoid ullage. An annular opening between the bolt and the annular disk-like piston head constitutes an injector for transfer of propellant from the reservoir to the combustion chamber as the piston is displaced responsive to combustion pressure. In particular, the invention contemplates use of a variable orifice hydraulic resistance to movement of the differential area piston by itself or in addition to other means for controlling the flow rate of propellant from a reservoir to a combustion chamber. The moveable third member provides shot-to-shot variable charge capability. The variable orifice hydraulic system permits shot-to-shot programmable mass flow rate of propellant into the combustion chamber. The invention disclosure also contains structural refinements facilitating loading, sealing, ignition and survival. The principal configuration has been tested to demonstrate the efficacy of the structure for obtaining desired ballistic results from predetermined breech pressure and time relationships as a result of controlled injection and burn rates.

DESCRIPTION OF THE INVENTION

General

Figure 1:
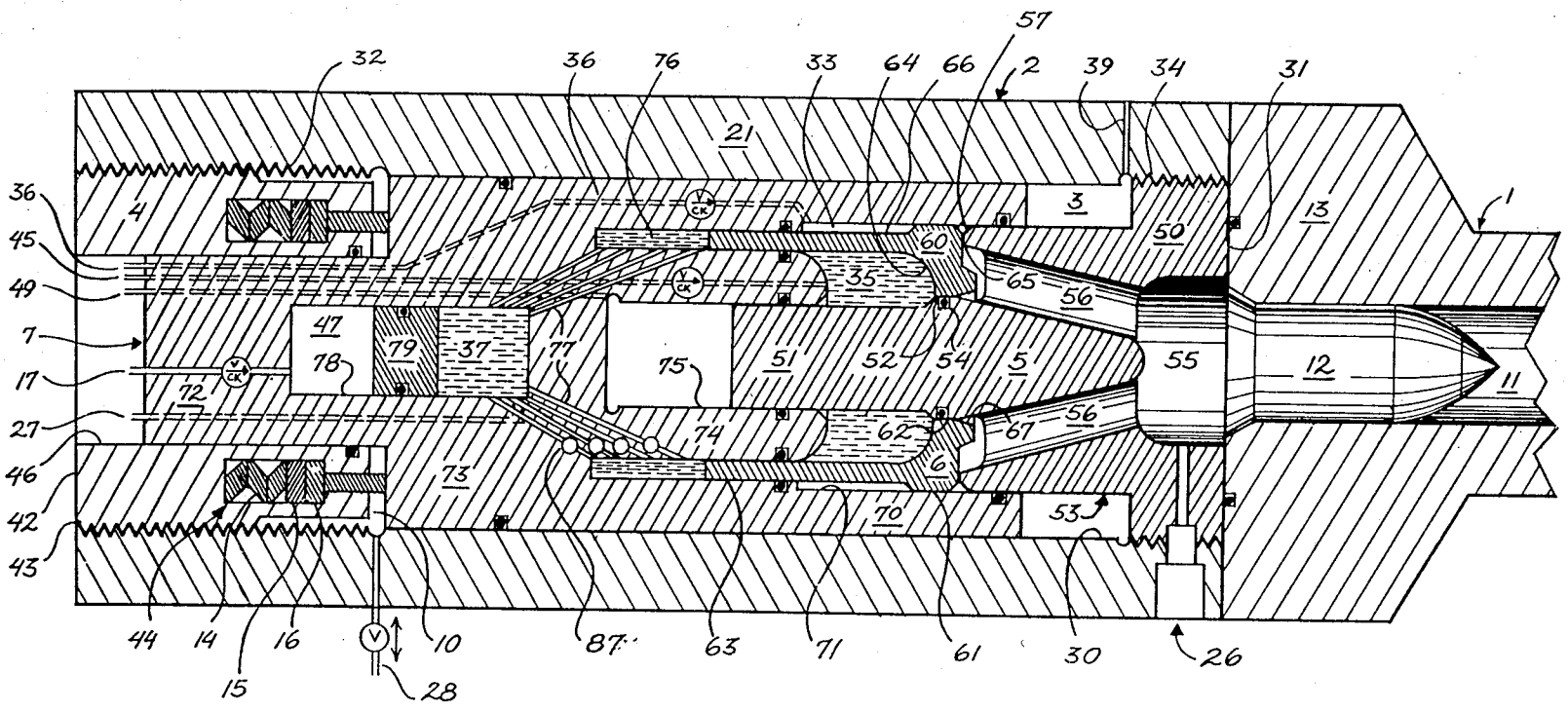
FIG. 1 is a longitudinal sectional view of a fully charged breech section of a variable charge regenerative liquid propellant gun in accordance with this invention.
Figure 2:
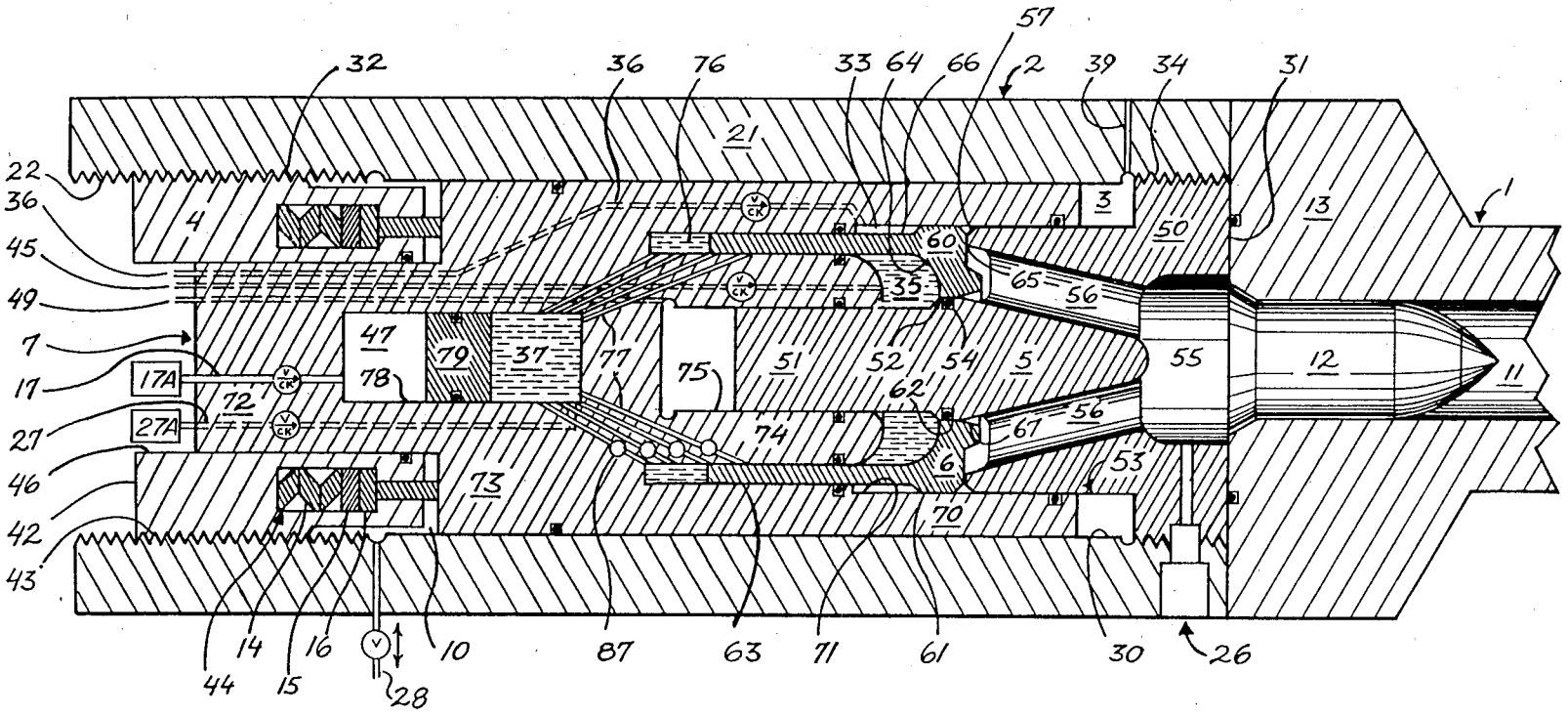
FIG. 2 is a longitudinal section view of the same gun structure having only half a charge as compared to that of FIG. 1.

The implementation of the breech or chamber section of a liquid propellant gun according to the invention and as illustrated in FIGS. 1 and 2 of the drawings includes, as common to most fire arms and cannon, a gun barrel 1 attached to an enlarged breech mechanism section 2 which includes provisions for the introduction, ignition and burning of a propellant material to create a gas to drive a projectile through the barrel. The breech section 2 of this gun includes a casing 21 surrounding and defining a chamber 3, a breech plug structure 4 restraining two moveable pistons a differential cross-sectional area injection piston 6 and a fill piston 7, and a fixed bolt structure 5. The moveable pistons cooperate with the bolt to accept, retain and dispense liquid propellant in a metered fashion in response to pressure created by combustion acting on differential area pressure piston 6.

Chamber 3 as defined by the interior wall 30 of the casing is cylindrical with one closed end wall 31 interrupted by the opening to the bore 11 of barrel 1 and two threaded portions 32 and 34 representing a facility for positioning and securing a breech closure mechanism, as for example, the breech plug structure 4, to provide reaction to the propulsion pressures and a facility for securing the fixed bolt structure 5 in place. Casing 21 is illustrated as merely abutting the enlarged barrel base 13 to constitute end wall 31 of the chamber without defined restraining means. Any of the well known structures, e.g. drop block, pivoted block, etc., which are outside of the scope of this invention may be used to join this novel breech to the barrel while permitting loading of projectiles 12. Breech plug structure 4 is representative of a wide range of possible designs and is illustrated as having plug portion 42, interconnection means 43 constituting in this case a screw threads for securing the plug to the threaded portion 32 of breech casing 21, spring buffer assembly 44 and internal bore 46 supporting fill piston 7 by means of a cylindrical portion 72. There is no reason to preclude the use of interrupted screw threads at 32 to provide for quick removal and adjustment.

Principal Components

Bolt 5 is fixed in place in the breech structure axially of the gun by a web structure 50 which has a threaded portion for attaching it to the threaded portion 34 of casing 21 and a reduced cylindrical portion 53 providing support for the annular forward portion 70 of moveable fill piston 7 which slides between the reduced bolt portion 53 and the casing wall 30. An essential aspect of this invention is embodied in the shaped or contoured portion of the bolt which, as shown in FIG. 1, has a cylindrical ledge portion 52 at the junction of the web structure 50, and the reduced radius shaft portion 51 of the bolt which is within the propellant reservoir 35. The cylindrical surface at 52 may carry a seal 54 and interfaces with the annular piston head 60 of the piston 6 in the position shown in FIG. 1. The web portion 50 of bolt 5 also contains an axial cup-like combustion chamber 55 facing the opening to barrel bore 11 and multiple passages 56 between the rear shoulder 57 of portion 53 and the combustion chamber. As illustrated, passages 56 are merely holes drilled through the monolithic portion 53 of bolt 5.

The differential area annular piston 6 has a cylindrical skirt portion 63 which serves as a piston rod and primarily defines cylindro-annular reservoir 35 about the shaft portion 51 of bolt 5 which varies in capacity as pistons 6 and 7 are moved relative to each other within the operating cylinder portion of chamber 3. Piston head 60, which separates reservoir 35 from the entrances to passages 56 to combustion chamber 55 and acts as a valve to control flow of propellant from the reservoir, is disk-like and annular in that it has a central hole defined by the cylindrical surface 62 dimensioned to the diameter of bolt ledge 52 to permit seating on the ledge. The interior surface 64 of cylinder head 60 which may be shaped as illustrated to facilitate propellant flow and to provide appropriate strength has, because of the thickness of skirt wall 63, a lesser exposed cross-sectional area than the exterior head surface and causes annular piston 6 to be a differential area piston acting between the combustion chamber and reservoir 35. Piston head 60 also has an exterior rim portion 61 journaled to the interior surface 71 of the cylindro-annular forward portion 70 of piston 7 which could be fitted with a piston ring. The exterior of piston 6 has a slightly reduced portion 66 which creates a narrow annular space 33 between the piston skirt 63 and the interior surface of the forward portion of piston 7.

The face of piston head 60 is shaped to provide a stop surface 65 which abuts the surface of shoulder 57 of bolt 5 when surface 62 is seated on bolt ledge 52. The central aperture of the piston head adjoining cylindrical surface 62 is also shaped to provide a conical surface 67 flaring away from cylindrical surface 62 so that the annular gap between the piston head and ledge 52 which constitutes an injection annulus increases gradually in size as piston 6 moves rearwardly during firing. The maximum size of the injection annulus is the difference in radii of the cylindrical surface 62 and the bolt shaft 51 which is reached as soon as the flared conical surface of the piston head clears the ledge 52. Although both the ledge 52 and the piston head annulus surface 62 are defined here as cylindical, it may be advantageous under certain conditions to have those surfaces made slightly conical, but less conical than surface 67, to facilitate seating and unseating.

The fill piston 7 of a liquid propellant gun according to this invention performs the same functions as that of U.S. Pat. No. 4,523,508, but also includes structure which is specific to the present invention. The fill piston 7 is fitted in chamber 3 for reciprocal motion and, as already noted, has a cylindro-annular forward portion 70 projecting from its main body 73 which surrounds the annular differential area pressure piston 6 and overruns the reduced cylindrical portion 53 of the bolt structure. A rear cylindrical portion 72 is journaled in bore 46 in the breech plug 4, both supporting the piston and sealing the opening in the breech plug. The main body 73 of piston 7 includes an annular nose portion 74 surrounding and defining a partial axial bore 75 journaled on the stem portion 51 of bolt 5. The nose portion is recessed with respect to the forward portion 70, is defined by an annular recess 76 in the body 73 contoured to receive the annular skirt 63 of annular piston 6 to constitute an annular dashpot and is shaped to mate with the internal surface 64 of the pressure piston 6 so that the capacity of reservoir 35 can be reduced to zero on firing and prior to fill.

Piston 7 in the illustrated embodiment also has an internal accumulator cylinder 78 (which could be external if desired) interconnected with the annular recess 76 which serves as a dash pot by multiple conduits 77 and is provided with pressurized feed line conduits 17 and 27 for charging the volumes 47 and 37 respectively. Free piston separator 79 with appropriate seals is located within cylinder 78 and serves to separate, and balance pressures between, the fluids in cylinder volumes 37 and 47 as they are charged through conduits 27 and 17 and respond to the results of relative movement between pistons 6 and 7. It is contemplated that cylinder portion 37, conduits 77 and dashpot 76 would be charged with water or a hydraulic fluid from a pressurized supply 27A via a check valve and cylinder portion 47 charged with air or gas under pressure from a pressurized supply 17A via a check valve. The accumulator structure is an essential component of the invention and with the strategic locations of the interconnections between the multiple conduits 77 and annular recess 76 and with the optional valves 87 in conduits 77 constitutes a variable or programmed orifice hydraulic damper provides a shot-to-shot programmable mass flow rate capability which includes use of different charge quantities of propellant in reservoir 35.

The gun breech structure illustrated also contains features more fully disclosed and explained in U.S. Pat. No. 4,523,508 including, for example, the annular space 33 closed off by an aligned seals carried by piston 7 as shown which also accommodate a variable capacity charge capability while retaining seal integrity. When charged with an appropriate fluid through conduit 36, annulus 33 can hydraulically support skirt 63 against firing pressures and can dispense lubricants, preservatives or combustion enhancements or combinations thereof past the piston head ring projection 61 into the combustion area. The breech structure 4 in this embodiment of gun is principally an annular breech block 42 which is adjustably retained in the casing by a threaded connection at 32 which as noted could be interrupted threads. It includes a spring buffer assembly 44 made up of Belleville washers 14, pressure ring 15 and pins 16 for positioning piston 7 and for allowing a set back movement of the combined structure of pistons 6 and 7 and the included reservoir 35 to unseat piston head 60 from ledge 52 to initiate feed of propellant from reservoir 35 to the combustion chamber. Other structure, e.g. a liquid spring, liquid damper, coil springs, etc., could be substituted for some of these elements. The structure also includes a drive cylinder 10 with conduit 28 for the insertion of fluid under pressure to drive piston 7 toward the barrel to reseat piston 6 onto the ledge 52 of bolt 5 in preparation for filling the reservoir. The structure also includes fill conduit 45 for the insertion of the liquid propellant and vent conduit 49 communicating with the enclosed cylindrical volume 78. In the embodiment illustrated, the flexible connections required to connect conduits 36, 45, 49, 17 and 27 to their proper supplies, valves, etc., are not shown because they are elements readily selected from available technology. The FIGURES include an igniter 26 communicating with combustion chamber 55 which can be of any convenient design but must have, or be accompanied by, a means for providing a sufficient charge to move pistons 6 and 7 to upseat piston head 60 from ledge 52 to open the annular injector.

FIG. 2.

The gun mechanism illustrated in FIG. 2 is the same mechanism as that in FIG. 1 but charged with only half of the amount of liquid propellant present in FIG. 1. This shows the adaptability of the structure, a prime feature of the design, and the slightly changed positions of the components with respect to one another to accommodate a half charge. Most noticeable are the smaller capacity of reservoir 35, the smaller volume of empty chamber at 3 between the forward end of piston 7 and chamber end wall 31, and the exposure of a length of screw threads 32 at 22 indicating that the adjustment of the mechanism to determine load charge is made by turning breech plug 4 farther into the chamber to reduce the distance between the nose portion 74 of piston 7 and piston head 60 in the loaded position. Less obvious is the volume reduction of annular recess 76 and a corresponding volume increase of the accumulator hydraulic cylinder 37. In addition to FIG. 2, some of the conduits 77 are obstructed by the bottom of skirt 63 of the annular piston 6. The number and location of conduits 77, as already noted, must be determined to produce the desired throttling a flow of hydraulic fluid as it is forced from recess 76 to accumulator 78 to produce the desired hydraulic resistance. The amount of hydraulic resistance to be applied is determined by taking into account all factors including the design of piston head 60, the size of the injection annulus, the burning characteristics of the particular propellant etc., to produce the desired pressure/time curve on firing. The location of conduits 77 to cause some to be blocked off by piston skirt 63 prior to firing a partial charge is a part of this determination. Other mechanical means could be used as a substitute for valves 87 to change the flow capacity of conduits 77.

OPERATION

Firing

The gun structure as illustrated in FIG. 1 is fully charged and ready for firing with reservoir 35 filled with the liquid propellant to the maximum capacity and with annular ring 62 of the annular piston 6 seated on ledge surface 52 of the belt so as to preclude leaking of the liquid propellant into the passages 56 leading to the combustion chamber 55. Space 33 is charged with an inert liquid to provide a hydraulic support for annular piston wall 63 during firing. The liquid in 33 as already noted may be very viscous, may have lubricant properties, or may contain materials chemically similar to those added to powders in conventional ammunitions for the treatment or preservation of barrels. The valve in conduit 45 is closed against backflow of the liquid propellant. Any existing pressure in space 10 and conduit 28 is relieved. Firing is initiated by means of activation of ignitor 26 which is provided with a charge or other means sufficient to create anough pressure in the combustion chamber 55 and communicating passages 56 to unseat piston head 60 from its mating position with the ledge on bolt 5 by driving the reservoir and fill piston 7 rearwardly against pins 16 partially collapsing belleville washers 14. The action of the igniter will both cause an initial injection of liquid propellant from reservoir 35 into combustion chamber 55 and ignite the so injected liquid propellant. Ignition of this liquid propellant flowing from reservoir 35 will increase the pressure in the combustion chamber and passages 56 and produce a regenerative feeding of liquid propellant from reservoir 35 into the combustion chamber because of the differential area piston head 60 of the annular piston. As the pressure in combustion chamber 55 and on the base of the projectile 12 increases, it reaches the point of causing the obturation band portion of the projectile 12 to become deformed and permit the projectile to move forwardly into the bore 11.

The conical surface 67 of the portion of the annular piston head 60 causes the annular space between that surface and the edge of ledge 52 to increase during early movement of the piston 6 to produce an ever increasing thickness in the annular sheet of liquid propellant injected into the combustion chamber until all of the surface 67 clears the ledge 52 after which the thickness of the annnular sheet is a function of the difference in diameters of bolt shaft 51 and annular surface 62. The initial flow rate of liquid propellant produces an increased burn rate with an attendant pressure increase which is adequate to overcome the increased volume of the combustion chamber caused both by aftward displacement of the annular piston head 60 and by the accompanying forward displacement of the projectile 12. The continued flow and burn rate after the injection annulus reaches full size, as already noted, is a function of the design of piston 6, the relative sizes and volumes of components and the characteristics of damping introduced by the variable orifice hydraulic damper which includes the dashpot recess 76, restrictive conduits 77, valves 87 and the accumulator structure 37, 47, 79. As the piston head of the injection piston 6 60 approaches the nose portion 74 of the fill piston 7, the injection piston 6 is brought to a halt hydraulically by the closing down of conduits 77 by piston skirt 63. The variable orifice hydraulic damper also provides tailored combustion chamber pressure rises to accommodate acceleration sensitive projectiles and projectiles of different weights.

Charging

At the completion of the firing, the annular injection piston 6 is seated onto fill piston 7 with piston 7 being located against or near the stops 16, depending on the relationship of the reaction of the buffer assembly and dissipation of the chamber pressures. After the insertion of a new projectile 12 by whatever breech action means has been incorporated into the specific gun using this invention, hydraulic or pneumatic pressure, whichever is used, may be inserted through conduit 28 to expand annular space 10 to drive both pistons, in register, toward the gun barrel until piston 6 seats onto the bolt ledge portion surface 52. The pressure on conduit 28 is then relieved and, if appropriate, breech plug 4 rotated, or reset if an interrupted screw is used, to obtain the proper position of stops 16 to provide for the proper capacity of reservoir 35 for the next firing. The valve in conduit 45 is then opened to admit liquid propellant under pressure into the collapsed reservoir at 35.

As liquid propellant is inserted into and expands reservoir 35 by forcing the fill piston 7 aftwardly away from the injection piston 6, if necessary, against a residual pressure in cylinder 10, to prevent, or at least reduce, the amount of gas ullage with the liquid propellant in the reseroir 35. The fill process is continued until the fill piston 7 seats onto pins 16. The gun mechanism is then charged for a subsequent firing and the annular space 33 can be filled if the charging system does not cause that to be effected as a result of the rearward movement of piston 7 which automatically expands a space 33.

SUMMARY

The foregoing describes the structure and operation of a regenerative monopropellant liquid propellant gun structure according to this invention employing the cooperation of a fixed axial bolt 5 and an annular piston 6 wherein the piston 6 cooperates with other members to define a reservoir 35 for liquid propellant, wherein the annular head 60 of the piston 6 overruns part of the bolt 5 as it moves in response to combustion pressure, cooperates with a shaped portion of bolt and with variable orifice hydraulic means for applying a variable resistance back pressure to the piston 6 to deliver a predetermined pattern and flow rate of propellant to the combustion chamber 55. An additional moveable piston member 7 cooperates with the annular piston 6 and with positioning means 10 to limit travel of the additional moveable piston member 7 to cause the propellant reservoir 35 to have a variable capacity to provide a variable charge capability and shot-to-shot programmable mass flow rate of propellant and to facilitate charging of the gun by permitting the capacity of the reservoir 35 to be increased from zero to a desired content as the liquid propellant is introduced into the reservoir 35 to provide for rapid propellant fill. Structural integrity is enhanced by use of a hydraulic pressure support of the annular piston rod which also facilitates lubrication and cooling of the structure.

The invention as claimed is:

1. In a regenerative injection liquid propellant gun structure having a breech casing and means for controlling the mass rate of flow of liquid propellant to a combustion chamber, wherein a first portion of a moveable differential area piston in the breech casing is interposed between a liquid propellant reservoir and a combustion chamber and moves relative to another structural component in said casing defining a portion of the boundary of the reservoir during firing to collapse said resevoir, the improvement comprising the combination of:

a. a recess in said other structural component facing said differential area piston;

b. a second portion of said differential area piston forming a secondary piston mating with said recess to form a dashpot;

c. an accumulator structure for charging the dashpot with a suitable operating fluid; and d. variable capacity fluid conduit means interconnecting said dashpot and said accumulator structure;

e. whereby said dashpot and accumulator structure when charged with a suitable fluid resists movement of said differential area piston during firing as a function of pressures created and the flow capacity of said variable capacity fluid conduit means and whereby said dashpot and accumulator structure constitute at least a part of the means for controlling the mass flow rate of liquid propellant from said reservoir to said combustion chamber.

2. The gun structure of claim 1 wherein:

said gun structure also includes a fixed member;

said first portion of said moveable differential area piston and a portion of said fixed member cooperate to define an injection orifice;

said gun structure also includes means closing said injection orifice to permit said gun structure to be charged and includes means for opening said orifice when said gun structure is fired; and said portions of said piston and said fixed member which cooperate to define an injection orifice are shaped so as to cause said orifice to open in response to movement of said piston at a predetermined rate to a predetermined maximum opening in response to pressure of combustion gas generated in said combustion chamber and dashpot resistance.

3. The gun structure of claim 2 wherein:

said fixed member is an elongated bolt having a cylindrical portion and an enlarged external annular portion;

said first portion of said moveable differential area piston is a piston head with an internal annular opening surface sized to seal to said external annular surface portion of said bolt;

said injection orifice is the resultant annular opening between an edge of said internal annular opening surface and said external annular portion as said piston moves away from said external annular surface portion and between said internal annular opening surface and the external surface of said bolt as said piston head continues to overrun said bolt;

said means for closing said orifice is comprised of means for moving said differential area piston to seat and seal said internal annular opening surface in said piston head on said external annular surface; and said means for opening said orifice is comprised of said differential area piston, said combustion chamber generating combustion gas acting on said piston, said fluid conduit means, and said dashpot.

4. The improvement of claim 1 wherein:

said moveable differential area piston is an annular piston with a hollow cylindrical wall and a head substantially closing one end thereby to define a portion of said reservoir;

the open end of said hollow cylindrical wall at the end opposite said head constitutes said secondary piston;

said other structural component is a generally cylindrical fill piston, having a first, outer hollow, cylindrical wall fitted in said casing for reciprocal motion and surrounding said differential area piston, and a second, inner, hollow cylindrical wall spaced from said first wall to define said dashpot recess between said two walls.

5. The improvement of claim 4 wherein:

said variable capacity fluid conduit means comprises a plurality of conduits interconnecting said accumulator structure with ports in said second wall at predetermined distances from the base of said dashpot recess whereby movement of said secondary piston of said annular piston into said dashpot recess in response to combustion gas generated in said combustion chamber will progressively block one or more of said ports to decrease the flow capacity of said conduit means in a predetermined pattern.

6. The improvement of claim 5 wherein:

one or more of said plurality of conduits also include valves for varying the flow capacity of said one or more conduits.

7. The improvement of claim 5 wherein:

said accumulator structure comprises:

fluid pressure means;

a closed cylinder;

a free piston in said cylinder dividing said cylinder into two chambers, a first chamber containing the connections to said variable capacity fluid conduit means and a second chamber containing at least a part of said fluid pressure means; and means for changing fluid pressure in said chambers.

8. The improvement of claim 7 wherein:

said gun structure also includes a fixed member;

said piston head and said fixed member cooperate to define an injection orifice between them; and said gun structure also includes means for moving said annular piston to close said orifice to permit said gun structure to be charged and includes means permitting said orifice to open at a predetermined rate to a predetermined maximum opening responsive to the interaction between combustion gas generated in said combustion chamber and said fluid pressure.

9. In a direct injection regenerative liquid propellant gun structure having a breech casing defining a breech bore having a forward barrel end and an aft breech end, the improvement comprising the combination of:

a fixed member within said breech bore extending from a supporting member near said barrel end aftwardly toward said breech end, said fixed member being generally cylindrical but having an enlarged portion near said supporting member;

a differential area injection piston having a head dividing the volume within said breech bore between a combustion chamber at said barrel end on the forward side of said piston head and a propellant reservoir on the aft side of said piston head, said differential area piston having a cut out portion for overrunning said fixed member as said piston moves along said fixed member from a gun charged disposition in which said cut out portion is in register with and forms a seal with said enlarged portion of said fixed member to a gun discharged disposition in response to the pressure of combustion gas generated in said combustion chamber to inject propellant from said reservoir to said combustion chamber;

said cut out portion and said enlarged portion being so sized and shaped to cooperate as said differential area piston moves with respect to said fixed member to define a variable area injection orifice between them for the flow of propellant from said reservoir to said combustion chamber.

10. The improved gun structure of claim 9 wherein:

said fixed member is a bolt spaced from the wall of said casing;

said differential area piston has a substantially planar piston head;

said cut out portion is an opening in said planar head;

said enlarged portion is a band protruding radially a discrete distance from said bolt;

the surfaces of said cut out portion and said band being configured both to mate a form a seal when said elements are in registry and to create a ringlike opening which expands at a predetermined rate with respect to movement of said piston relative to said bolt to a maximum opening measured by said discrete distance when the distance of said planar head from said band exceeds said discrete distance, whereby the rate of expansion of the ringlike opening and the maximum opening through which propellant flows from the reservoir to combustion chamber may be determined, at least in part, by the configurations of said cutout portion and said band.

11. The improved gun structure of claim 10 wherein:

said bolt is fixed axially of said breech by a web structure removably secured in the barrel end of said breech;

said differential area piston is an annular hollow piston having a cylindrical wall extending from the periphery of said planar head toward said breech end of said casing, said periphery and said cylindrical wall being spaced from the interior wall of said casing, and said cut out being centered in said cylindrical head;

there is a second piston having a body portion journaled in said breech casing for reciprocal movement and two concentric cylindrical wall projections extending from said body portion toward the barrel and defining an annular slot between them, the outer of said two cylindrical walls fitting between said differential area piston and said casing, and the inner of said two cylindrical walls fitting between said bolt and the cylindrical wall of said differential piston to constitute a fill piston; and said reservoir is an annular volume of variable capacity defined by said bolt, the differential area piston and the fill piston;

whereby the open end of said cylindrical wall of said differential area piston constitute a secondary piston portion of said piston and whereby the space between said concentric cylindrical wall projections of said fill piston constitutes an additional cylinder in which said secondary piston portion operates.

12. The improved gun structure of claim 11 wherein:

there is an accumulator structure in said body portion of said fill piston comprising an accumulator cylinder, means for charging said accumulator cylinder with fluid pressure and fluid conduit means interconnecting said accumulator cylinder and said additional cylinder;

whereby, when said accumulator structure is charged with a fluid, said additional cylinder and said secondary piston constitute a dashpot providing resistance to movement of said differential area piston during firing.

13. The improved gun structure of claim 12 wherein:

said fluid conduit means interconnecting said accumulator cylinder and said additional cylinder include a plurality ports into said additional cylinder which are located so as to be sequentially closed as said differential area piston moves from its gun charged position to its gun dicharged position during firing;

whereby said dashpot provides a variable hydraulic resistance to movement of said differential area piston.

14. The improved gun structure of claim 13 further comprising:

adjustable valve means in said fluid conduit means interconnecting said accumulator cylinder and said additional cylinder for regulating the flow capacity of said fluid conduit means:

whereby the movement of said differential area piston can also be influenced by the adjustment of said valve means to control hydraulic resistance behind the differential area piston.

15. In a direct injection regenerative liquid propellant gun structure having a breech casing defining a breech bore having a barrel end and a barrel end, the improvement comprising the combination of:

a. a fixed member removably secured within the barrel end of said breech bore and fixing and positioning an elongated bolt relative to a combustion chamber also defined by said fixed member, said bolt having a peripheral circumferential band constituting a ledge and a cylindrical portion of lesser diameter than said band extending from said band toward the breech end of said bore;

b. a hollow annular differential area piston in said breech bore surrounding said bolt, having an annular discoidal piston head with a hole fitting said band on said bolt and a cylindrical skirt extending from proximate the circumference of said head toward said breech end, said skirt being evenly spaced from said breech casing to define an annular gap between piston and bore;

c. a second piston journaled in said breech bore for reciprocal movement between said breech end of said bore and the space occupied by said bolt and differential area piston, said second piston having:

a medial portion, a barrel facing portion on one side of the medial portion comprised of an exterior cylindrical sleeve for overrunning said annular piston and a portion of said fixed member as it reciprocates and an interior sleeve-like projection fitting between said skirt of said annular piston and said cylindrical portion of said bolt, and a base portion of reduced diameter on the second side of the medial portion, said interior sleeve-like projection defining with said exterior sleeve an annular dashpot cylinder in which said cylindrical skirt is received as a plunger, and by itself also defining a central receptacle for receiving the end of said bolt, said interior sleeve-like projection also in cooperation with the interior of said annular piston defining a variable capacity reservoir for liquid propellant;

d. a breech plug component removably and adjustably secured in the breech end of said casing for positioning and retaining said pistons in said bore, said breech plug component having means for interfacing with and supporting said base portion of said second piston;

e. fluid recouperator means in said medial portion including a pressure cylinder, fluid conduit means interconnecting said pressure cylinder and said dashpot cylinder and means for varying the flow capacity of said fluid conduit means responsive to position of said annular differential area piston.

16. The gun structure of claim 15 wherein:

said recouperator pressure cylinder also includes a free piston separating said cylinder into a hydraulic cylinder communicating with said fluid conduit means and a pressure control cylinder communicating with an exterior source of pressure;

said fluid conduit means comprises a plurality of conduits;

said means for varying the flow capacity comprises the location of said conduits so that the interface of said conduits with said dashpot cylinder are successively closed by said annular piston during firing.

17. The gun structure of claim 16 further comprising fluid pressure supply lines running from exterior fluid sources to said reservoir, to said central receptacle, to said pressure control cylinder and to said hydraulic.

* * * * *